US008561535B2

(12) United States Patent
Sabia et al.

(10) Patent No.: US 8,561,535 B2
(45) Date of Patent: Oct. 22, 2013

(54) METHOD OF SCREEN PRINTING ON 3D GLASS ARTICLES

(75) Inventors: Robert Sabia, Corning, NY (US); Kathleen Ann Wexell, Corning, NY (US)

(73) Assignee: Corning Incorporated, Corning, NY (US)

( * ) Notice: Subject to any disclaimer, the term of this patent is extended or adjusted under 35 U.S.C. 154(b) by 372 days.

(21) Appl. No.: 13/027,469

(22) Filed: Feb. 15, 2011

(65) Prior Publication Data

US 2011/0209634 A1 Sep. 1, 2011

Related U.S. Application Data

(60) Provisional application No. 61/308,935, filed on Feb. 27, 2010.

(51) Int. Cl.
*B41M 1/12* (2006.01)
*B05C 17/04* (2006.01)

(52) U.S. Cl.
USPC ..... 101/129; 101/123

(58) Field of Classification Search
USPC ..... 101/35, 41, 123, 127, 127.1, 129
See application file for complete search history.

(56) References Cited

U.S. PATENT DOCUMENTS 5,660,875 A * 8/1997 Muchi et al. ..... 427/64
6,041,702 A * 3/2000 Ichikawa et al. ..... 101/35
6,698,345 B2 3/2004 Cutcher
7,182,019 B2 * 2/2007 Cutcher et al. ..... 101/123
2008/0163770 A1 * 7/2008 Bui et al. ..... 101/123
2009/0101027 A1 * 4/2009 Goetz et al. ..... 101/123

FOREIGN PATENT DOCUMENTS

JP 60008072 A * 1/1985
WO 20060798008 A2 7/2006

* cited by examiner

*Primary Examiner* — Ren Yan
(74) *Attorney, Agent, or Firm* — Walter M. Douglas

(57) ABSTRACT

A method of screen printing on 3D glass articles includes providing a 3D glass article having a first 3D surface with a first surface profile and a second 3D surface with a second surface profile, the first 3D surface and the second 3D surface being separated by a thickness of glass. The method includes providing a fixture having a 3D fixture surface with a fixture surface profile matching the second surface profile. The method includes providing a screen having a design, a squeegee, and an ink. The 3D glass article is supported on the fixture by mating the second 3D surface with the 3D fixture surface. The screen is positioned at a plane a distance above the first 3D surface. The ink is deposited on the screen. The squeegee is positioned at a selected orientation relative to the plane. The ink is pushed through the screen onto the first 3D surface by simultaneously contacting the squeegee with the screen, traversing the squeegee in a linear direction, maintaining the orientation of the squeegee relative to the plane, locally deflecting the screen from the plane to the first 3D surface, and locally conforming the screen to the first surface profile.

20 Claims, 6 Drawing Sheets

METHOD OF SCREEN PRINTING ON 3D GLASS ARTICLES

CROSS-REFERENCE TO RELATED APPLICATIONS

This application claims benefit of U.S. Provisional Application No. 61/308,935 filed on 27 Feb. 2010. The disclosure of this provisional application is incorporated herein by reference.

FIELD

The present invention relates generally to screen printing methods. More specifically, the present invention relates to a method of screen printing a design on a three-dimensional (3D) surface.

BACKGROUND

Manufacturers of consumer electronics devices, such as laptops, tablets, and smart phones, are demanding 3D glass covers for their displays. These 3D glass covers would have printed designs on their inside surfaces. When the devices are assembled with the 3D glass covers, the printed designs would hide the innards of the devices while providing clear apertures for the displays to operate. The printed designs would be required to meet very precise specifications. For small display applications, such as smart phones, meeting these very precise specifications economically is challenging.

Screen printing is a method that is widely used for printing designs on surfaces. In screen printing, a design is created on a fine mesh material called a screen. The design is created by masking off certain areas of the screen while leaving other areas open. The screen with the design is stretched on a frame. Then, a paste of ink is applied on the screen using a floodbar. A machine or operator draws a squeegee across the screen while applying a load to the squeegee. As the squeegee is drawn across the screen, ink is pushed through the open areas of the screen onto the surface.

U.S. Pat. No. 6,698,345 issued to Cutcher (the '345 patent) describes a method and an apparatus for screen printing on the inside surface of a curved substrate. The method includes mounting the curved substrate in a recess of a support member. The curved substrate is urged against the recess by vacuum. The inside surface of the curved substrate is brought into contact with a screen mounted on a screen mounting frame that is capable of conforming to the inside surface. The screen mounting frame has a right side, a left side, a front portion, and a rear portion. The right and left sides each have vertically movable center portions and end portions, where the center portions are each bounded by at least two hinges. The screen mounting frame is deflected by means of these movable and hinged portions.

In the method of the '345 patent, ink is applied to the screen while the screen is in a generally flat, horizontal position. The screen mounting frame is deflected, as described above, to substantially conform the screen to the inside surface of the curved substrate. Then, the ink is urged through the deflected screen with a squeegee. The squeegee is attached to a pendulum capable of pivotal movement. The length of the pendulum arm may be fixed or adjustable. The '345 patent discloses that the method may be employed to print a pattern on the inside surface of a curved substrate where the radius of curvature is approximately 20-80 inches, measured from the pivotal mounting point of the pendulum.

SUMMARY

In one aspect, the present invention relates to a method of screen printing on 3D glass articles. The method comprises providing a 3D glass article having a first 3D surface with a first surface profile and a second 3D surface with a second surface profile, the first 3D surface and the second 3D surface being separated by a thickness of glass. The method includes providing a fixture having a 3D fixture surface with a fixture surface profile matching the second surface profile. The method includes providing a screen having a design, a squeegee, and an ink. The method includes supporting the 3D glass article on the fixture by mating the second 3D surface with the 3D fixture surface. The method includes positioning the screen at a plane a distance above the first 3D surface. The method includes depositing the ink on the screen. The method includes positioning the squeegee at a selected orientation relative to the plane. The method includes pushing the ink through the screen onto the first 3D surface by simultaneously contacting the squeegee with the screen, traversing the squeegee in a linear direction, maintaining the orientation of the squeegee relative to the plane, locally deflecting the screen from the plane to the first 3D surface, and locally conforming the screen to the first surface profile.

In one embodiment, the method further includes controlling traversing of the squeegee such that a change in deflection of the screen as the squeegee moves past a junction between the 3D glass article and the fixture is limited to 100 microns.

In one embodiment, the step of pushing the ink is such that a design printed on the first 3D surface by pushing of the ink onto the first 3D surface has a registration resolution of +/−100 microns and a break edge resolution of +/−50 microns.

In one embodiment, a difference in height between a top edge of the 3D glass article and a top surface of the fixture is in a range from 0 microns to 100 microns.

In one embodiment, the step of supporting the 3D glass article includes clamping the second 3D surface to the 3D fixture surface by vacuum.

In one embodiment, the step of supporting the 3D glass article includes applying an adhesive layer between the 3D surface and the 3D fixture surface.

In one embodiment, the first 3D surface of the 3D glass article is concave.

In one embodiment, the first 3D surface of the 3D glass article has a bottom surface, at least one side surface, and at least one corner surface joining the bottom surface to the at least one side surface.

In one embodiment, an angle between the at least one side surface and the bottom surface is in a range from 90 degrees to 180 degrees measured from the bottom surface to the at least one side surface.

In one embodiment, an angle between the at least one side surface and the bottom surface is in a range from 90 degrees to 135 degrees, measured from the bottom surface to the at least one side surface.

In one embodiment, the at least one corner surface has a radius of curvature in a range from 1.5 mm to 10 mm.

In one embodiment, the method further includes curing the ink pushed onto the first 3D surface.

In one embodiment, the ink pushed onto the first 3D surface is a UV curable ink, and curing the ink includes exposing the ink to UV light.

In one embodiment, the method further includes providing a further screen having a design and a further ink and repeating positioning the screen, depositing the ink, positioning the squeegee, and pushing the ink using the further screen and further ink instead of the initial screen and initial ink.

In one method, the further ink is different from the initial ink.

In one method, the initial ink or the further ink is provided based on one or more ink properties selected from the group consisting of reflectivity, transparency in the infrared range, transparency in the visible range, and color.

In one embodiment, the color of the initial ink or further ink is selected from the group consisting of blue, grey, white, and red.

In one embodiment, at least one of the screen and a blade of the squeegee has a contour that matches the first surface profile in at least one dimension.

These and other aspects and embodiments of the present invention will be further described below.

BRIEF DESCRIPTION OF THE DRAWINGS

The following is a description of the figures in the accompanying drawings. The figures are not necessarily to scale, and certain features and certain views of the figures may be shown exaggerated in scale or in schematic in the interest of clarity and conciseness.

DETAILED DESCRIPTION

Figure 1A:
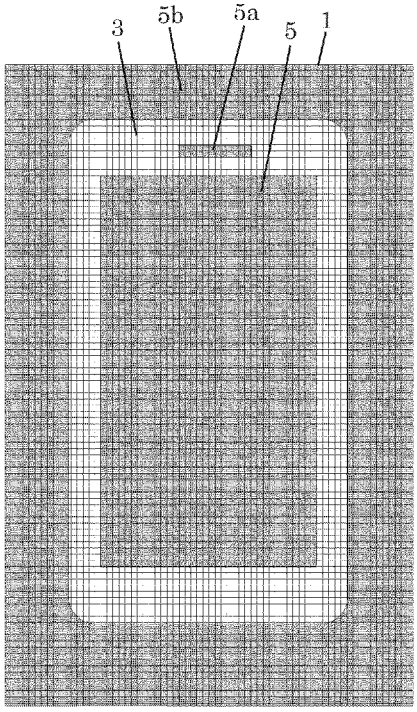
FIG. 1A is a schematic of a screen having a design.

In the following detailed description, numerous specific details may be set forth in order to provide a thorough understanding of embodiments of the invention. However, it will be clear to one skilled in the art when embodiments of the invention may be practiced without some or all of these specific details. In other instances, well-known features or processes may not be described in detail so as not to unnecessarily obscure the invention. In addition, like or identical reference numerals may be used to identify common or similar elements.

A method is disclosed herein for screen printing a design on a printable surface of a 3D glass substrate or article. Here, a "printable surface" is the surface of the glass substrate on which the design will be printed. In one or more embodiments, the printable surface is generally concave. In one embodiment, the glass substrate has a simple-concave printable surface. In another embodiment, the glass substrate has a complex-concave printable surface. In one embodiment, the complex-concave printable surface is made of one or more side surfaces, a bottom surface, and one or more corner surfaces joining the one or more side surfaces to the bottom surface. The bottom surface could be a 2D surface or a 3D surface. In one embodiment, the one or more side surfaces are 2D surfaces. In another embodiment, the one or more side surfaces are 3D surfaces. The angle between a side surface and a bottom surface may range from 90 degrees (vertical) to 180 degrees (horizontal) in one embodiment and from 135 degrees to 180 degrees in another embodiment. The angles are measured from the bottom surface to the side surface. The corner surface is typically a curved surface and may have a radius of curvature ranging from 1.5 mm to 10 mm in one embodiment. In another embodiment, the complex-concave printable surface is contoured along two dimensions.

One or more embodiments of the method described herein are suitable for screen printing on small printable surfaces, e.g., surfaces smaller than 10 inches by 10 inches, of 3D glass substrates. One or more embodiments of the method described herein can be used to apply a uniform layer of ink, typically 10 microns or less thick, on a printable surface of a 3D glass substrate with the appropriate opacity and edge definition. One or more embodiments of the method described herein can be used to print a design that meets a specification of aperture location/registration to ±100 microns, break edge (i.e., line) resolution to ±50 microns, and ink regression from the edge of less than 20 microns.

Figure 1B:
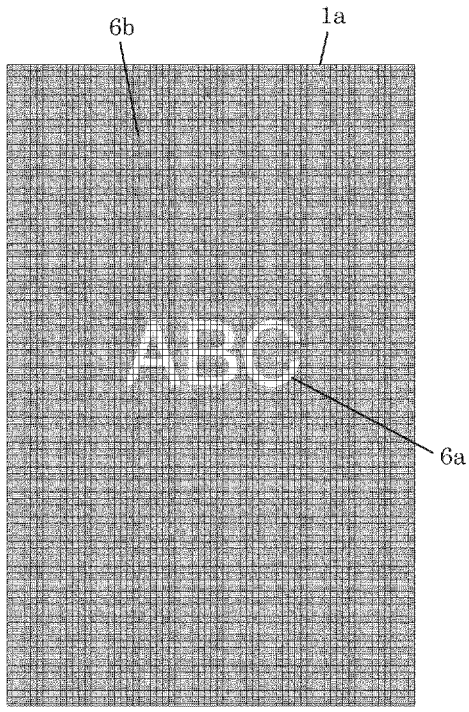
FIG. 1B is a schematic of another screen having a design.

FIG. 1A is a top view of a screen 1 for screen printing a design on a printable surface of a glass substrate. Screen 1 is made of a fine mesh material. Suitable examples of mesh material for the screen include porous stainless steel, nylon, and polyester. Screen 1 has a design formed thereon. The design on the screen can be any desired design. For illustration purposes, the design shown in FIG. 1A is defined by a combination of the area 3 with open pores and areas 5, 5*a*, 5*b* with masked-off or blocked pores. FIG. 1B shows another screen 1*a* with a design defined by a combination of the area 6*a* with open pores and area 6*b* with masked-off or blocked pores. In a practical application, the design shown in FIG. 1A may be used to print a border on the printable surface. Then, the design shown in FIG. 1B may be used to print an insignia in the space within the border with an ink having specific characteristics, such as transparency at a specific range of wavelengths. Returning to FIG. 1A, screen 1 will typically be slightly larger than the actual size of the 3D glass substrate to allow for flexing of the screen over the printable surface of the 3D glass substrate. The slightly larger screen will also allow for ink to be wrapped around the edge of the 3D glass substrate when the squeegee traverses across the screen to deposit ink onto the printable surface of the 3D glass substrate, as will be further described below.

Figure 3:
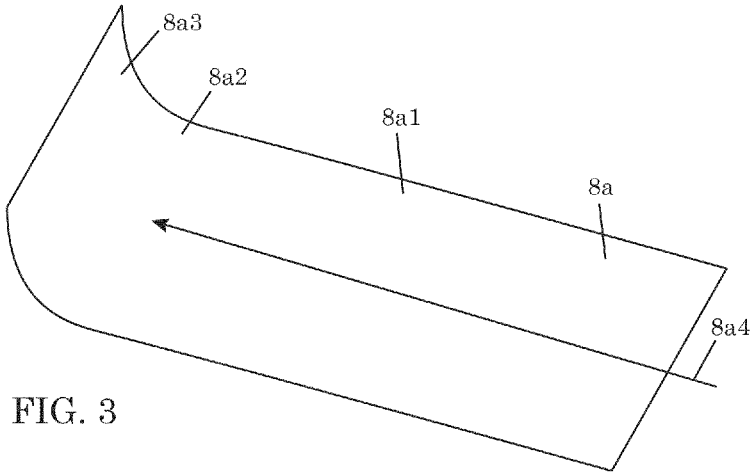
FIG. 3 is a perspective view of a 3D printable surface.
Figure 2:
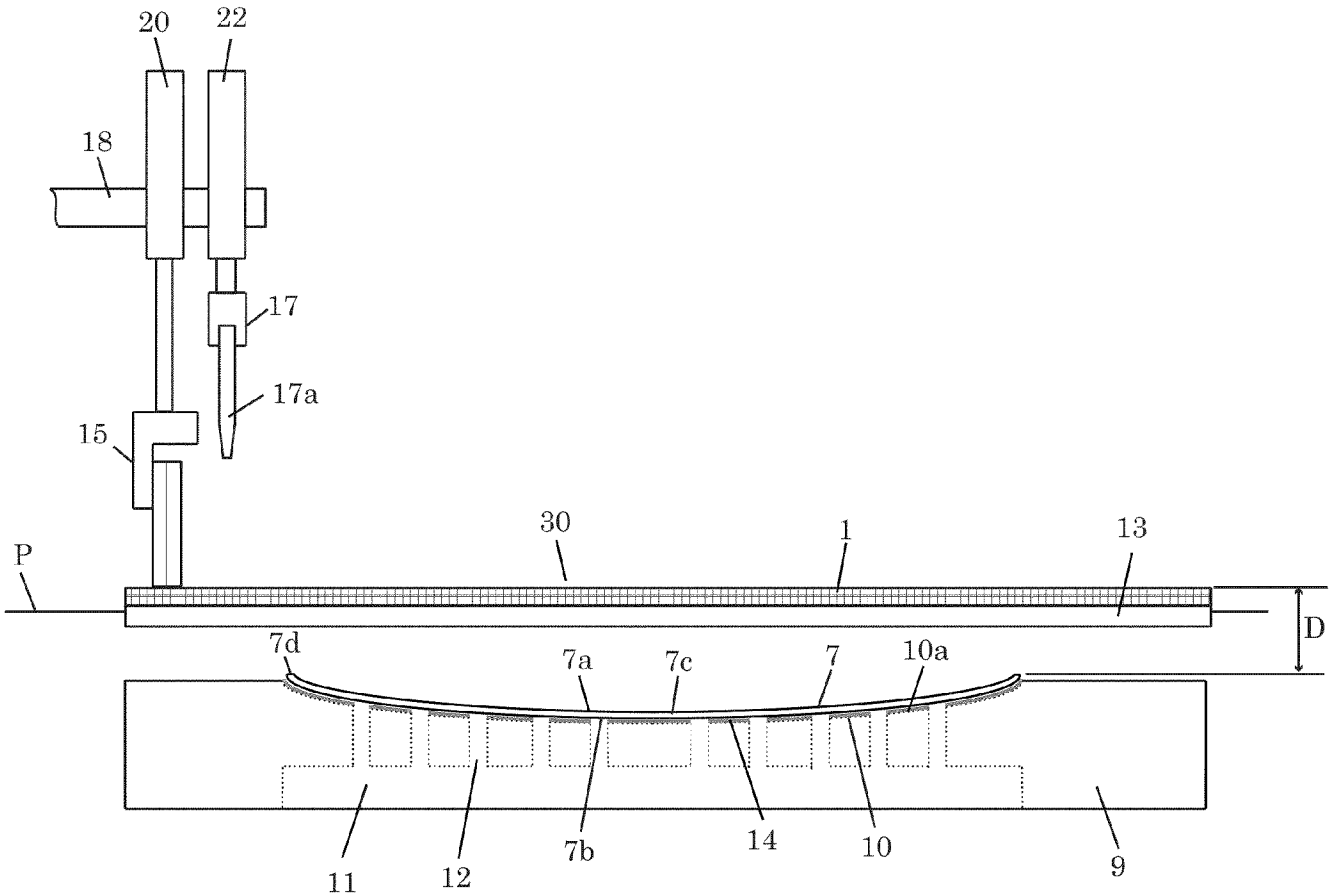
FIG. 2 is a schematic of a system for screen printing a design on a 3D surface.
Figure 4:
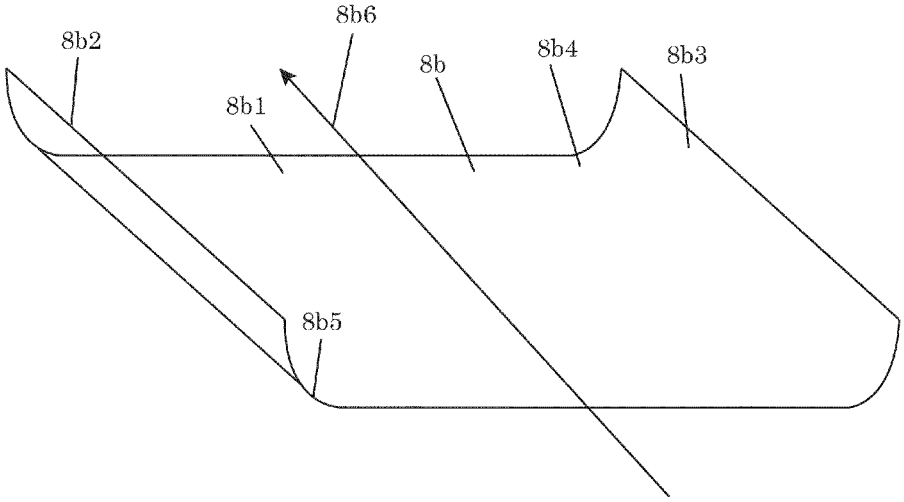
FIG. 4 is a perspective view of another 3D printable surface.
Figure 5:
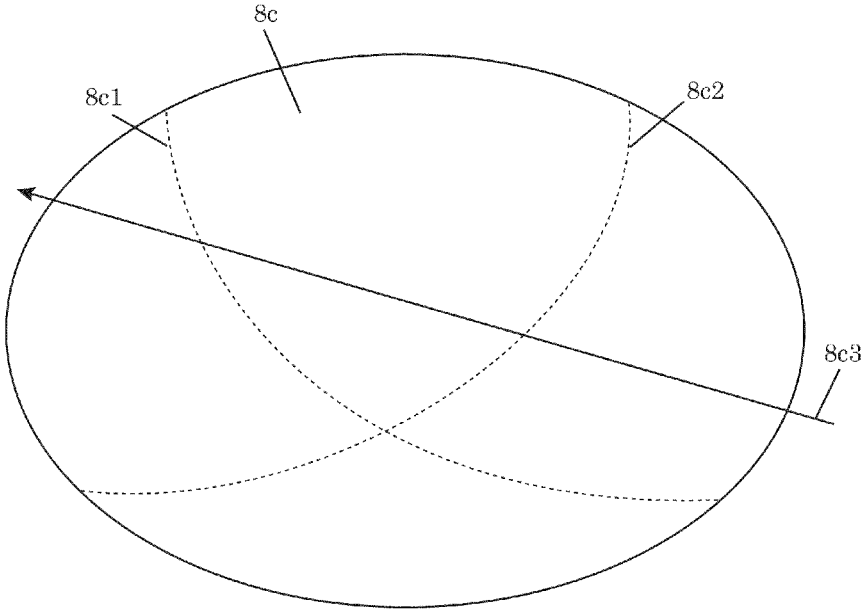
FIG. 5 is a perspective view of another 3D printable surface.

FIG. 2 shows a 3D glass substrate 7 mounted in a vacuum chuck 9. The 3D glass substrate 7 may be made of any suitable glass material for the intended application. Ion-exchange, chemically-strengthened glass materials are useful for glass substrates used as glass covers of displays for consumer electronics devices. These glass materials typically have a high breaking strength. The printable surface 7*a* of the 3D glass substrate 7 has a simple-concave shape. Examples of printable surfaces having complex-concave shapes are shown in FIGS. 3, 4, and 5. In FIG. 3, the printable surface 8*a* has a bottom surface 8*a*1, a corner surface 8*a*2, and a side surface 8*a*3. The arrow 8*a*4 shows the direction in which a squeegee will travel relative to the printable surface 8*a* when a design is being printed on the printable surface 8*a*. In FIG. 4, the printable surface 8*b* has a bottom surface 8*b*1, side surfaces 8*b*2, 8*b*3, and corner surfaces 8*b*4, 8*b*5. The arrow 8*b*6 shows the direction in which a squeegee will travel relative to the printable surface 8*b* when a design is being printed on the printable surface 8*b*. In FIG. 5, the printable surface 8*c* is contoured along a first dimension 8*c*1 and along a second dimension 8*c*2. The arrow 8*c*3 shows the direction in which a squeegee will travel relative to the printable surface 8*c* when a design is being printed on the printable surface 8*c*.

Returning to FIG. 2, the 3D glass substrate 7 has a top 3D surface 7*a* and a bottom 3D surface 7*b*. The 3D surfaces 7*a*, 7*b* are separated by a thickness of glass material 7*c*. The top 3D surface 7*a* is the printable surface of the 3D glass substrate 7. The vacuum chuck 9 has a 3D surface 10 defining a recess 10*a*. The surface profile of the 3D surface 10 of the vacuum chuck 9 matches that of the bottom 3D surface 7*b* so that when the 3D glass substrate 7 is mounted in the vacuum chuck 9, the 3D surface 10 mates with the bottom 3D surface 7*b*. In this manner the 3D glass article is fully supported around its periphery by the vacuum chuck 9. Cavity 11 and holes 12 are provided in the vacuum chuck 9 for applying vacuum to the bottom 3D surface 7*b*. To apply the vacuum, the cavity 11 and holes 12 would need to be connected to a vacuum pump. An adhesive layer 14 may be applied between the bottom 3D surface 7*b* of the 3D glass substrate 7 and the 3D surface 10 of the vacuum chuck 9 to further secure the glass substrate 7 in the recess 10*a*. The adhesive layer 14 may also provide a separation layer between the material of the vacuum chuck 9, which may be metal, and the material of the 3D glass substrate 7. The adhesive layer 14 is intended to be temporary and will be removed from the 3D glass substrate 7 after printing.

Figure 6:
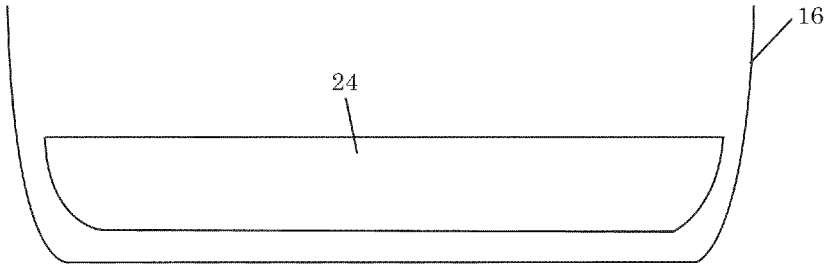
FIG. 6 is a schematic of a contoured screen and contoured squeegee.

Screen 1 is stretched on a horizontal frame 13. The frame 13 is positioned at a plane P above the 3D glass substrate 7. The position of the frame 13 on the plane P is adjusted such that the design on the screen 1 is precisely aligned with the printable surface 7*a* of the 3D glass substrate 7. Fiducial on the screen 1 and vacuum chuck 9 may assist in aligning the design on the screen 1 with the printable surface 7*a*. The distance D between the screen 1 and the top edge 7*d* of the 3D glass substrate 7 is one factor that may be selected to achieve high quality printing. In one embodiment, this distance is between 2 mm and 4 mm. In FIG. 2, the screen 1 is flat. In other embodiments, the screen may be contoured, i.e., have a 3D shape. The shape of the screen may be the same as the shape of the printable surface 7*a* in one embodiment, or the screen may be contoured to match the contour of the printable surface 7*a* in at least one dimension. FIG. 6 shows an example of a contoured screen 16, which may be used to print a design on a complex-concave printable surface such as shown at 8*b* in FIG. 4.

In FIG. 2, a floodbar 15 and squeegee 17 are supported above the screen 1. The floodbar 15 and squeegee 17 can linearly travel across the screen 1 by means of a suitable translation mechanism 18 (such as a linear slide) coupled to the floodbar 15 and squeegee 17. The floodbar 15 and squeegee 17 may also each have a dedicated translation mechanism so that each can linearly travel across the screen 1 separately. The floodbar 15 and squeegee 17 are also separately extendable towards the screen 1 by means of translation mechanisms (such as piston assemblies) 20, 22, respectively. The floodbar 15 can be extended to the screen 1 to spread ink over the screen 1, and the squeegee 17 can be extended to the screen 1 to push ink through the screen 1. The squeegee 17 may be vertical to the plane P as shown or may be at an angle to the plane P. Typically, an orientation of the squeegee 17 relative to the plane P is established and maintained during the printing process. The sides of the squeegee blade 17*a* of the squeegee 17 are flat in some embodiments. In other embodiments, the sides of the squeegee blade may be contoured to match the contour of the printable surface of a 3D glass substrate in one dimension. FIG. 6, for example, shows a contoured squeegee blade 24 suitable for use with the contoured screen 16.

Figure 7:
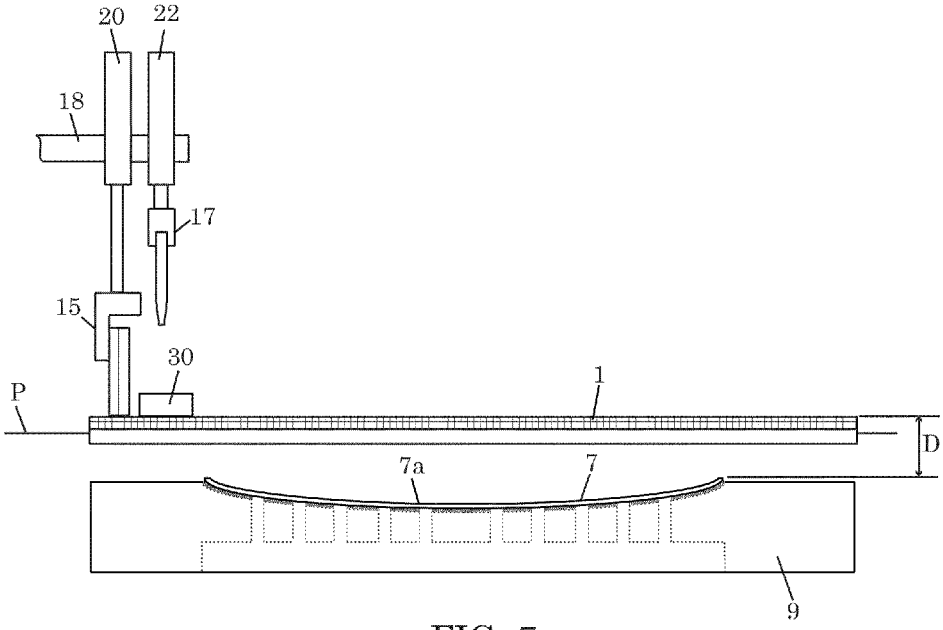
FIG. 7 illustrates a step in screen printing of a design on a 3D surface.
Figure 8:
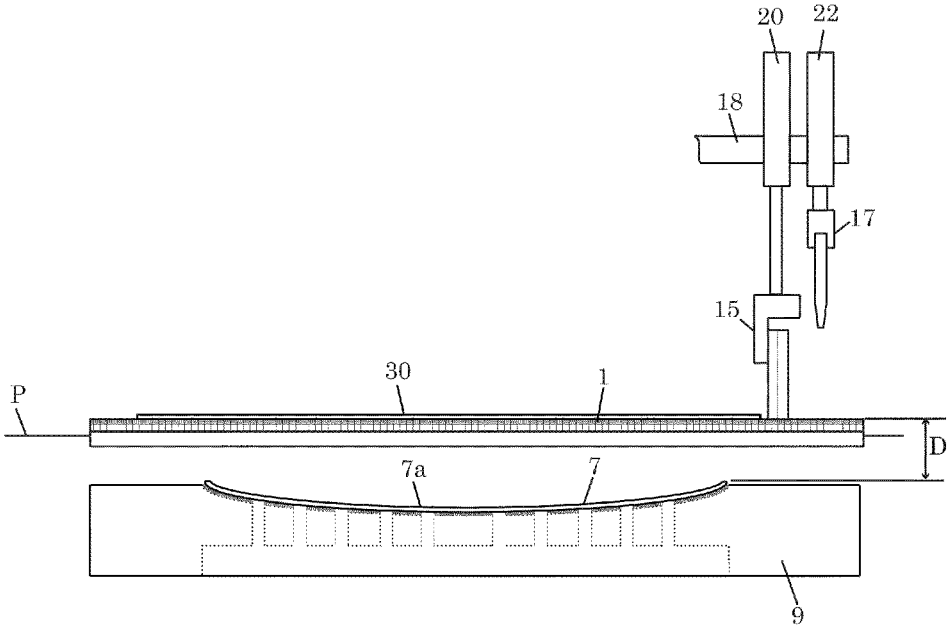
FIG. 8 illustrates another step in screen printing a design on a 3D surface.
Figure 9:
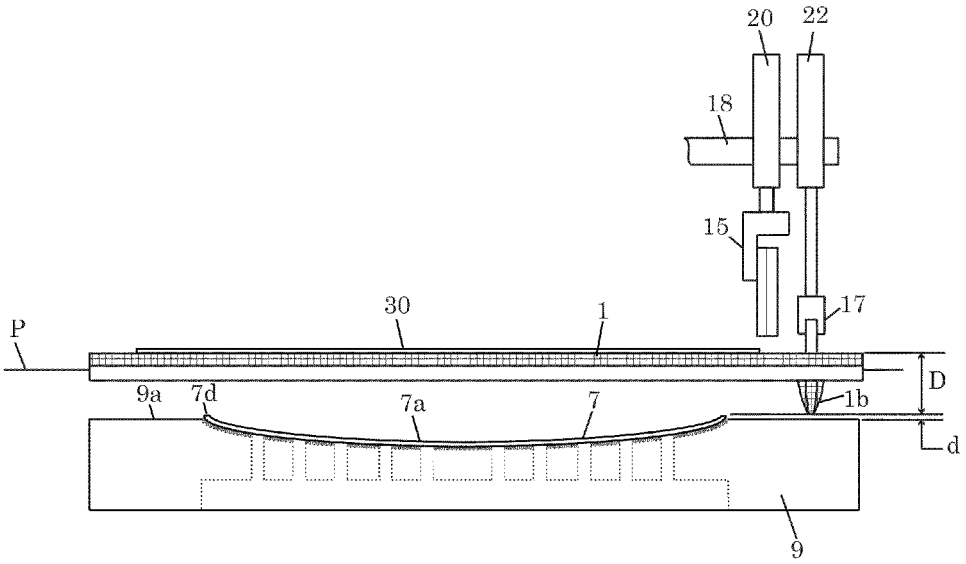
FIG. 9 illustrates another step in screen printing a design on a 3D surface.

FIGS. 7-9 show steps in screen printing a design on a 3D glass substrate. In FIG. 7, a roll of ink 30 is placed on the screen 1. The ink 30 is placed at or near one end of the screen 1. Typically, this end will not include the design to be printed on the printable surface 7*a*. The floodbar 15 is lowered into close proximity with the screen 1, while the squeegee 17 remains raised from the screen 1. In FIG. 8, the floodbar 15 and squeegee 17 are translated across the screen 1. As the floodbar 15 is translated across the screen 1, it spreads a specific thickness of ink 30 over the portion of the screen 1 including the design. The thickness of the ink 30 spread across the screen 1 may be controlled by the gap between the floodbar 15 and the screen 1. In FIG. 9, the floodbar 15 is raised from the screen 1, and the squeegee 17 is lowered to the screen 1. Before lowering the squeegee 17, the squeegee 17 is placed at a desired orientation relative to the plane P. For example, the squeegee 17 may be vertical to the plane P as shown in FIG. 9 or may be tilted relative to the plane P. A force is applied to the squeegee 17 to deflect the screen 1 locally, vertically, and downwardly from the plane P, as shown at 1*b*. The force may be applied by the translation mechanism 22. Under the conditions described above, the squeegee 17 and floodbar 15 are translated in a linear direction across the screen 1. The floodbar 15 is raised from the screen 1 during this translation. However, the squeegee 17 continues to deflect the screen 1 locally, vertically, and downwardly as it moves in the linear direction across the screen 1. The height of the squeegee 17 relative to the printable surface 7*a* is adjusted as the squeegee 17 moves in the linear direction so that the screen 1 is deflected to the printable surface 7*a*. A controller having information about the contour of the printable surface 7*a* along the linear direction may be used to control the translation mechanism 22 and height of the squeegee 17. The squeegee 17 may also be spring-mounted and naturally biased towards the printable surface so that it automatically traces the contour of the printable surface 7*a* as it travels in the linear direction. In some embodiments, the allowable deflection of the screen 1 during translation of the squeegee 17 may be in a range from 0.1 mm to 5.0 mm.

While the squeegee 17 is translated across the screen 1 as explained above, the ink 30 is pumped or squeezed by capillary action onto the printable surface 7*a* of the 3D glass substrate 7 in a controlled and prescribed amount, i.e., the wet ink deposited is equal to the thickness of the screen. As the squeegee 17 moves over the screen 1, the tension of the screen material and the print gap between the screen 1 and the printable surface 7*a* helps pull the screen up away from the printable surface 7*a* (this is called snap-off), leaving the ink on the printable surface 7*a*. Means for adjusting the design on the screen 1 may be provided to correct any printed image distortion from screen deflection. The printing starts at a first area of the screen not including the design, continues through a middle area of the screen including the design, and ends at a second area of the screen not including the design. This is to ensure that the squeegee traverses the entire middle area including the design. The first area and second area are at opposite ends of the middle area. A second design can be printed on the printable surface 7*a* using the same method described above. For the second printing, a different screen with the second design, or the same screen with the second design, and a different ink, or the same ink, may be used. The inks used in printing may have be selected based on one or more properties selected from reflectivity, transparency in the infrared range, transparency in the visible range, and color. In one embodiment, the color may be selected from blue, grey, white, and red. After depositing ink on the printable surface 7*a*, the ink is cured. The curing method would depend on the type of ink, as will be further discussed below.

Referring to FIG. 9, in some embodiments, the junction between the top surface 9*a* of the vacuum chuck 9 and the top edge 7*d* of the 3D glass substrate 7 is made substantially flush so as to avoid abrupt changes in the deflection of the screen 1 when the squeegee moves past this junction. In one embodiment, abrupt changes in deflection by more than 100 microns when the squeegee moves past this junction is avoided. The distance d between the top edge 7*d* and the top surface 9*a* is in a range from 0 microns to 100 microns in one embodiment, from 10 microns to 80 microns in another embodiment, and from 20 microns to 50 microns in yet another embodiment. It is generally preferable that the distance between the top edge 7*d* and the top surface 9*a* is greater than 0 microns, with the top edge 7*d* being higher than the top surface 9*a*. This is so that the screen 1 can be deflected to the correct depth to start printing on the printable surface 7*a* without the screen 1 touching the top surface 9*a* of the vacuum chuck 9. Avoiding contact between the screen 1 and vacuum chuck 9 may improve the longevity of the screen.

Figure 10:
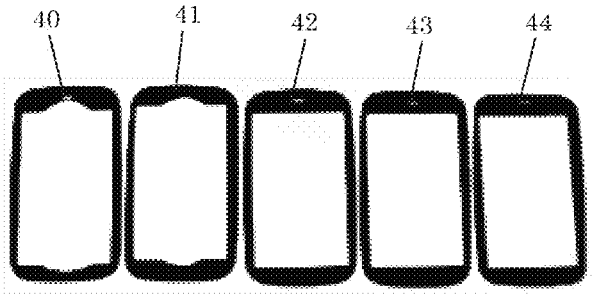
FIG. 10 shows examples of screen printed designs.

FIG. 10 shows a set of screen printed designs on 3D glass substrates using different screen printing parameters. The inner print edge on the first two prints 40, 41 do not meet desired specifications, while the inner print edge on the remaining three prints 42, 43, 44 meet desired specifications. FIG. 10 demonstrates the need for all printing conditions, such as positioning, stroke speed, squeegee pressure, print gap, and proper ink, to be defined in order for repeatable quality prints to be made.

Using the method above, the criteria in Table 1 were met for printing black ink area on a printable surface of a 3D glass substrate.

TABLE 1

| | |
|---|---|
| Optical density | greater than or equal to 3.0 |
| Thickness of print | not to exceed 10 microns ± 2 microns |
| Distance of print from outer edge of substrate | outer edge of print can exceed by 20 microns, but no recede is allowed |
| Surface quality of print | no pinholes, no deflects (such as particulate matter, impact areas, chips, scratches), coloration and finish must be uniform over entire print area |
| Inner print edge | must meet dimensional open aperture size specifications with less than 30 microns ink leakage into clear aperture area |

Using the method above, the criteria in Table 2 were met for printing white/red/blue ink area on a printable surface of a 3D glass substrate.

TABLE 2

| | |
|---|---|
| Optical density | greater than or equal to 2.0 |
| Thickness of print | 10 microns ± 2 microns |
| Distance of outer edge print area | outer edge of print cannot exceed 20 micron in ink leakage |
| Surface quality of print | no pinholes, no deflects (such as particulate matter, impact areas, chips, scratches), coloration and finish must be uniform over entire print area |

Using the method above the criteria in Table 3 were met for printing smokey ink area on printable surfaces of 3D glass substrates.

TABLE 3

| | |
|---|---|
| Optical density | 1.5 to 2.0 |
| Thickness of print | 10 microns ± 2 microns |
| Distance of outer edge print area | outer edge of print cannot exceed 20 micron in ink leakage |
| Surface quality in print | no pinholes, no defects (such as particulate matter, impact area, chips, scratches) |
| Scratch resistance | must attain 4B rating or higher using ASTM D-3359 |
| Light leakage | no light leakage allowed |
| Environmental test | must withstand 85° C./85% humidity for 72 hours |
| Solvent reliability test | no hazing or ink removal with 10,000 wipes |
| Lamination test | no bubbles present |
| Adhesion tape test | using model PA-2000 kit (for coatings between 2 and microns and cuts using 6 teeth, 2 mm cutter) |
| Clear aperture contact angle | using deionized water, angle needs to be less than 10 degrees |

The image design chosen for a particular pattern is influenced by the screen material and the diameter of the material. The emulsion and the thickness of the screen material factor into the amount of ink deposited onto the substrate surface. When screen printing on a 3D glass substrate, flexure is important to maintain ink thickness. This is another reason for the glass substrate being fully supported by the vacuum chuck. The tightness of the weave of the screen material and the bias angle at which the weave of the material is stretched for optimal tension affect the quality of the fine line edge of the substrate. In some embodiments, a screen mesh 355-34P 22.5° bias E11 emulsion 10-12 microns thick has been found to be satisfactory.

Squeegees, though simple, are important factors in printing success. Hardness, shape, edge quality, and angle allow the ink to transfer through the screen in a proper manner onto the substrate surface. Squeegee selection has to address abrasion, cut, and solvent resistance, be free from additives for the ink and application chosen. Squeegee/ink combination have to be tested for swelling or softening, which demonstrates an incompatibility between the two components. In one or more embodiments, a squeegee made from polyurethane with a durometer of 70-75 Shore A (medium hardness) with an angle of 60° was chosen for printing. The blade of the squeegee needs to be rigid enough to transfer ink through the screen, but should also be soft enough to adapt to the contour of the screen and substrate. A 70 Shore A durometer blade has performed satisfactorily in terms of rigidity and softness.

The ink used in printing a design on the printable surface will be selected based on the glass material and to achieve good adherence. The ink can be selected from thermally curable ink, UV (ultraviolet) curable ink, or ink comprised of a UV/solvent system. Thermally curable inks have been used for printing on glass. As will be explained below, when the material of the glass is an ion exchanged, chemically strengthened glass, a UV curable ink may offer advantages over a thermally curable ink. The ink used in printing may be optimized to maximize adhesive to the printable surface. For a UV curable ink, the ink is cured using a UV lamp radiation system. In mass manufacturing, a tunnel UV curing system may be used for high throughput. Some UV curable inks come with an ink base and a catalyst to be mixed prior to use. Other UV curable inks come with the catalyst already premixed into the ink base. Solvent can also be added to the UV curable ink to modulate the viscosity to an optimum level, but the addition of volatile component to the ink would negate some of the advantages of the UV curable ink and significantly limit shelf life of the mixture.

By definition, thermally curable ink is cured by baking at high temperatures, generally between 80° C. and 180° C. The typical baking time is 30 to 60 minutes, which results in low throughput, a large number of Work-in-Progress (parts) in the production process, and significant floor space and capital investment dedicated to the thermal curing equipment. Furthermore, solvent and other volatile hazardous and flammable materials are vaporized from the ink base during the thermal cure, causing complications and additional expenses in environmental controls and effluent treatment. Solvents and other volatile materials also evaporate from the ink base at room temperature during the printing process, causing the ink to become increasingly viscous during printing and introduce variability into the process. Dried ink tends to clog screen openings, causing "pin hole" defects, and if hardened over time, become very difficult to clean with solvents. Most thermally curable inks can only be printed for 1 to 4 hours before becoming too viscous for the optimal printing process.

UV curable inks, on the other hand, are cured in the presence of UV light. The ink curing process is a photochemical reaction, with UV-sensitive monomers cross-linking under UV radiation, resulting in hardening of the ink and solid adhesion on glass surface. Inks of different color have different absorption and transmittance characteristics. UV curable inks with lower absorption rate and higher transmittance require comparatively less energy to cure, and cure more easily. Black ink's absorption in the UV range is usually higher, and thus cures more slowly. For white inks, the high reflectivity also results in longer curing cycles. In general, UV wavelength absorption decreases with increasing wavelength of the ink color, i.e., black>purple>blue>green>yellow>red. The UV curing process completes within a few seconds, occurs at relatively low temperatures, and is thus more efficient compared to the high temperature cure of the thermally curable inks. The volatile materials content in this class of ink is negligible without significant amount of hazardous and combustible solvents vaporized during the curing process. The lack of volatile compounds also results in very stable ink viscosity and fluidics over very long printing runs, ranging from 6 hours to multiple days. There is little dried ink flakes to block screen openings, and residual ink is easily washed off by screen cleaning solvents. When optimized for specific glass substrates, the UV curable ink performs similarly to or better than the thermally curable inks in the following aspects: optical density, cured ink layer thickness profile, adhesion reliability test (thermal cycle, thermal shock, high temperature, high humidity, salt vapor test), defect, and yield.

Figure 11:
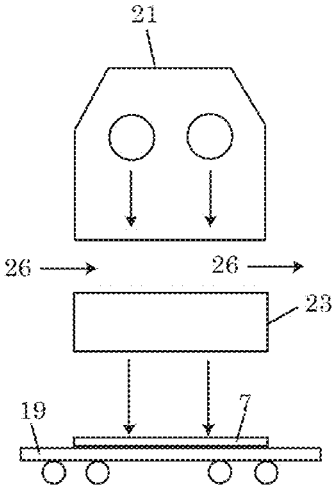
FIG. 11 illustrates UV curing of a printed design.
Figure 12:
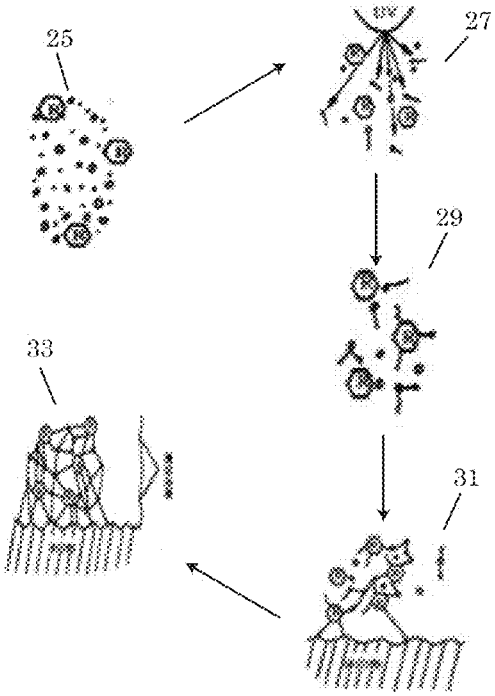
FIG. 12 illustrates a photochemistry mechanism of UV curable ink.

After depositing UV curable ink on the glass substrate, the glass substrate is exposed to UV light to cure the ink. A suitable arrangement is shown in FIG. 11, where the glass substrate 7 with the printed design is mounted on a movable platform 19 positioned below a UV source 21. A filter 23 may be disposed between the UV source and substrate to filter out wavelengths of the UV light not needed in curing the ink. Cooling air 26 may be circulated around the filter 23 and substrate 7 during the curing process. FIG. 11 shows the photochemistry mechanism of UV curable ink. The UV curable ink before exposure to UV light is shown at 25. R represents resins, and the dots represent photoinitiators. At 27, the UV curable ink is exposed to UV light. The photoinitiators absorb UV light and are thereby raised to an excitation state. In this excited state, the photoinitiators photolyze or degrade into free radicals. These free radicals become the initiating species that cause rapid polymerization of the resins. At 29, a chain reaction starts with the resins being attracted by radicals. At 31, free radical polymerization and cross-linking of the resins occur. At 33, the chain reaction is complete and a final solid structure is shown.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

The invention claimed is:

1. A method of screen printing on 3D glass articles, comprising:

(a) providing a 3D glass article having a first 3D surface with a first surface profile and a second 3D surface with a second surface profile, the first 3D surface and the second 3D surface being separated by a thickness of glass;

(b) providing a fixture having a 3D fixture surface with a fixture surface profile matching the second surface profile;

(c) providing a screen having a design, a squeegee, and an ink;

(d) supporting the 3D glass article on the fixture by mating the second 3D surface with the 3D fixture surface;

(e) positioning the screen at a plane a distance above the first 3D surface;

(f) depositing the ink on the screen;

(g) positioning the squeegee at a selected orientation relative to the plane; and (h) pushing the ink through the screen onto the first 3D surface by simultaneously contacting the squeegee with the screen, traversing the squeegee in a linear direction, maintaining the orientation of the squeegee relative to the plane, and locally deflecting the screen from the plane to the first 3D surface, and locally conforming the screen to the first surface profile by the squeegee during the traversing movement of the squeegee in the linear direction.

2. The method of claim 1, further comprising:

(i) controlling traversing of the squeegee such that a change in deflection of the screen as the squeegee moves past a junction between the 3D glass article and the fixture is limited to 100 microns.

3. The method of claim 1, wherein step (h) is such that a design printed on the first 3D surface by pushing of the ink onto the first 3D surface has a registration resolution of +/−100 microns and a break edge resolution of +/−50 microns.

4. The method of claim 1, wherein step (h) is such that a thickness of the ink pushed onto the first 3D surface is 10 microns or less.

5. The method of claim 1, wherein a difference in height between a top edge of the 3D glass article and a top surface of the fixture is in a range from 0 microns to 100 microns.

6. The method of claim 1, wherein step (d) comprises clamping the second 3D surface to the 3D fixture surface by vacuum.

7. The method of claim 1, wherein step (d) comprises applying an adhesive layer between the second 3D surface and the 3D fixture surface.

8. The method of claim 1, wherein the first 3D surface of step (a) is concave.

9. The method of claim 1, wherein the first 3D surface of step (a) has a bottom surface, at least one side surface, and at least one corner surface joining the bottom surface to the at least one side surface.

10. The method of claim 9, wherein an angle between the at least one side surface and the bottom surface is in a range from 90 degrees to 180 degrees, measured from the bottom surface to the at least one side surface.

11. The method of claim 9, wherein an angle between the at least one side surface and the bottom surface is in a range from 90 degrees to 135 degrees, measured from the bottom surface to the at least one side surface.

12. The method of claim 9, wherein the at least one corner surface has a radius of curvature in a range from 1.5 mm to 10 mm.

13. The method of claim 1, further comprising:

(j) curing the ink pushed onto the first 3D surface.

14. The method of claim 13, wherein the ink of step (c) is a UV curable ink, and wherein step (j) comprises exposing the ink to UV light.

15. The method of claim 1, further comprising:

(k) providing a further screen having a design and a further ink; and (l) repeating steps (e), (f), (g), and (h) using the further screen and further ink instead of the screen and ink of step (c).

16. The method of claim 15, wherein the design of the further screen of step (k) is different from the design of the screen of step (c).

17. The method of claim 15, wherein the further ink of step (k) is different from the ink of step (c).

18. The method of claim 15, wherein the ink of step (c) or the further ink of step (k) is provided based on one or more ink properties selected from the group consisting of reflectivity, transparency in the infrared range, transparency in the visible range, and color.

19. The method of claim 18, wherein the color is selected from the group consisting of blue, grey, white, and red.

20. The method of claim 1, wherein at least one of the screen and a blade of the squeegee provided in step (c) has a contour that matches the first surface profile in at least one dimension.

* * * * *